United States Patent [19]

Cornu

[11] 4,121,854

[45] Oct. 24, 1978

[54] ELECTRO-PYROTECHNIC UNLOCKING DEVICE, IN PARTICULAR FOR A SAFETY FIXTURE FOR A SKI

[75] Inventor: Julien Cornu, Toulouse, France

[73] Assignee: Etablissements Ruggieri, Monteux, France

[21] Appl. No.: 789,592

[22] Filed: Apr. 21, 1977

[30] Foreign Application Priority Data

Apr. 23, 1976 [FR] France ..... 76 12085
Sep. 9, 1976 [FR] France ..... 76 27147

[51] Int. Cl.[2] ..... A63C 9/00
[52] U.S. Cl. ..... 280/612; 89/1 B; 280/DIG. 13
[58] Field of Search ..... 89/1 B, 1 R; 280/611, 280/612

[56] References Cited

U.S. PATENT DOCUMENTS

| | | | |
|---|---|---|---|
| 3,119,302 | 1/1964 | Barr | 89/1 B |
| 3,133,408 | 5/1964 | Stott | 89/1 B X |
| 3,671,054 | 6/1972 | Mittlestadt | 280/611 |
| 3,919,563 | 11/1975 | Lautier et al. | 280/612 X |

FOREIGN PATENT DOCUMENTS

| | | | |
|---|---|---|---|
| 2,519,544 | 5/1975 | Fed. Rep. of Germany | 280/612 |

*Primary Examiner*—David H. Brown
*Attorney, Agent, or Firm*—Sughrue, Rothwell, Mion, Zinn and Macpeak

[57] ABSTRACT

The device is automatically re-armed and comprises at least one pyrotechnic jack and a push-member actuated by the jack for unlocking the fixture. A loader carries a plurality of pyrotechnic charges for actuating the jack in succession. A device is provided for igniting the charges and a device is provided for positioning the charges of the loader with respect to the push-member and with respect to the device for igniting the charges.

27 Claims, 16 Drawing Figures

ELECTRO-PYROTECHNIC UNLOCKING DEVICE, IN PARTICULAR FOR A SAFETY FIXTURE FOR A SKI

The present invention relates to an automatically re-armed electro-pyrotechnic unlocking device and more particularly, although not exclusively, to such a device applied to a safety fixture or binding for a ski.

Safety fixtures are known which are opened by a pyrotechnic charge which is ignited by means responsive to critical exterior influences when said influences appear or act.

An object of the invention is to provide an unlocking device of the aforementioned type which is relatively simple in construction and easy to use.

According to the invention, there is provided an automatically re-armed and reloaded electro-pyrotechnic unlocking device in particular for a safety ski binding, comprising at least one gas operated mechanical assembly for unlocking said binding, a loader, a plurality of pyrotechnic charges for actuating said assembly in succession and carried by the loader, means for igniting the charges, and means for automatically positioning the charges of the loader with respect to said assembly and with respect to said means for igniting the charges.

Further features and advantages of the invention will be apparent from the ensuing description with reference to the accompanying drawings which are given solely by way of example and in which.

Figure 1:
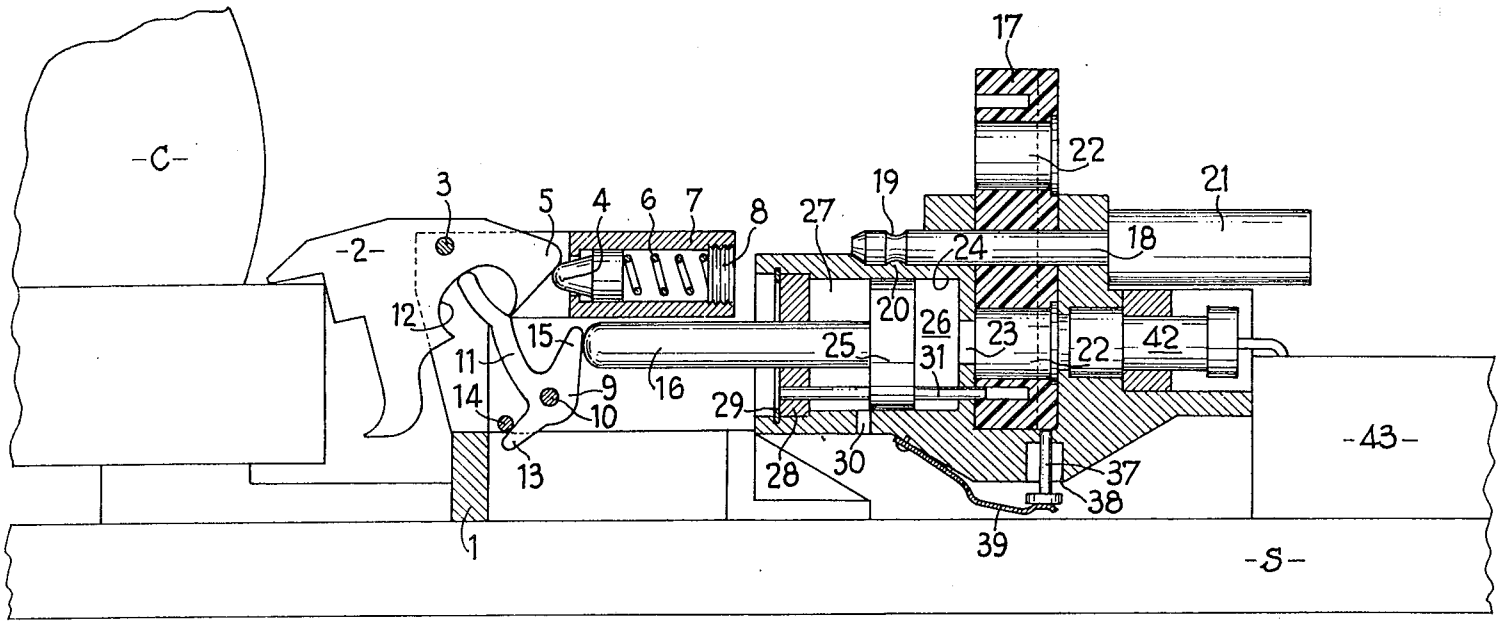
FIG. 1 is an elevational and sectional view of a safety fixture for a ski comprising an electro-pyrotechnic unlocking device according to the invention, the fixture being shown in the locked state.

The electro-pyrotechnic unlocking device shown in FIG. 1 is considered to be applied to a safety fixture or attachment of a ski which fixture comprises a body 1 fixed to a ski S and carrying a clamp 2 for maintaining the sole of a shoe C and pivotally mounted on the body 1 by a pin 3. The clamp is maintained in the position shown in FIG. 1 by a bolt member 4 which is applied against a nose portion 5 of the clamp by a spring 6.

The bolt member 4 is mounted to be movable in translation in a cylinder 7 which is integral with the body 1 and contains the spring 6 maintained against the bolt member 4 by a screwthreaded plug 8. The fixture further comprises an auxiliary member 9 which is pivotally mounted on the body 1 by a pin 10.

The member 9 has a first branch 11 which cooperates with a cam surface 12 of the clamp 2, a second branch 13 adapted to cooperate with a stop 14, and a third branch 15 adapted to receive the thrust exerted by a push-member 16 of the unlocking device.

The latter comprises a loader 17 in the form of a barrel mounted to rotate on a shaft 18 which is in the form of a plug pin introduced into a bore in the body 1 and provided at one end thereof with a groove 19 which cooperates with a rib 20 formed on the surface of the body 1 in alignment with said bore.

The plug pin 18 is advantageously provided with an extension 21 so as to facilitate its insertion into and its extraction from the bore of the body 1 when replacing the barrel.

The barrel 17 is provided with six cartridges 22 which are evenly spaced 60° apart from each other.

Each cartridge 22 can thus be brought into alignment with an orifice 23 for putting the cartridge in communication with the cylinder 24 of a pneumatic jack whose piston 25 carries the aforementioned push-member 16.

The piston 25 defines two chambers 26 and 27 in the cylinder 24, the chamber 27 being closed by a plug 28 through which the push-member 16 extends and which is maintained in position by a circlip 29. The chamber 27 opposed to the orifice 23 has at least one opening 30 for communication with the atmosphere.

The piston 25 is provided with a rod 31 for controlling the position of the barrel 17 and extending through the plug 28 closing the cylinder 24 of the jack.

Figure 2:
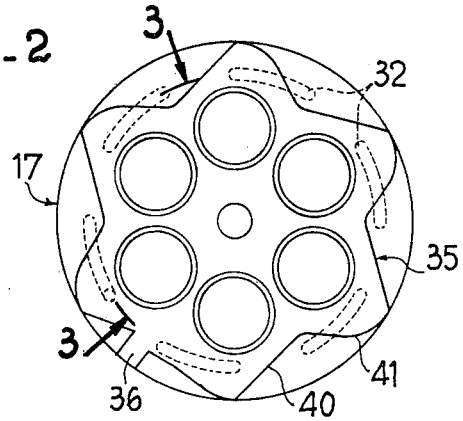
FIG. 2 is a front elevational view of the barrel of the device shown in FIG. 1.
Figure 3:
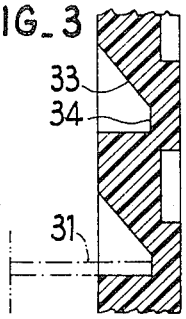
FIG. 3 is a sectional view taken on line 3—3 of FIG. 2.

As can be seen in FIGS. 2 and 3, the positioning rod 31 cooperates with curved recesses 32 formed in the face of the barrel 17 on a circumference surrounding cavities for the cartridges 22. The number of the recesses 32 is equal to the number of cartridges. As shown in FIG. 3, the inner end of each recess has the shape of a ramp 33 extended by a portion 34 of maximum depth located on a radius of the barrel extending through the centre of the corresponding cartridge 22.

In the face of the barrel opposed to the recesses 32 the barrel is provided with a series of radial cams 35 the number of which is equal to the number of cartridges contained in the barrel.

The cams are interconnected in a continuous manner except for the first and last cam which are separated by an abutment surface 36.

The cams 35 cooperate with a follower or pawl 37 which is radially movable with respect to the barrel 17 in a cavity 38 in the body 1 and biased against the cams 35 by a spring 39.

Each cam 35 has a portion 40 of decreasing section and a section 41 of increasing section each of which portions subtends an angle of 30° at the centre of the barrel.

When the pawl 37 bears against a portion 40 of decreasing section, it causes the rotation of the barrel, under the action of the spring 39, whereas when the pawl 37 bears against a portion 41 of increasing section, it permits the compression of the spring by the movement of rotation of the barrel 17 under the action of the positioning rod 30 which cooperates with the ramp 33 of the inner end of the recess 32 in which it is engaged.

FIG. 2 shows that the recesses 32 extend angularly of the barrel through the same angle as the portions of increasing section 41 of the corresponding cams 35.

The electro-pyrotechnic unlocking device shown in FIG. 1 comprises an electric connector 42 connected to an electronic control circuit 43 and adapted to transmit to the cartridge 22 an igniting or fixing pulse produced by said circuit. The connector 42 has advantageously an elastically yieldable contact (not shown) with which the charges 22 are put into contact in succession upon each displacement of the barrel 17.

Figure 5:
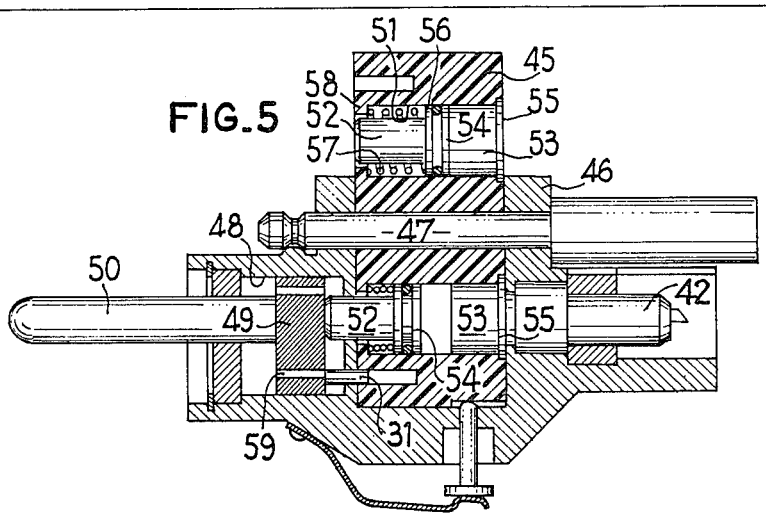
FIG. 5 is a partial sectional view of a modification of the device shown in FIG. 1.

The device shown in FIG. 5 comprises, as the previously described device, a loader in the form of a barrel 45 rotatively mounted on the body 46 by means of a shaft 47 in the form of a plug pin. The body 46 has a bore 48 in which there is slidably mounted a disc 49 provided with a rod 50 constituting a pushmember adapted to cooperate with the member 9 (FIG. 1).

The barrel 45 has six bores 51 in each of which there is slidably mounted a finger member 52 which is shiftable by a pyrotechnic charge 53.

The part of the bore 51 containing the charge 53 is partitioned off by sealing discs 54 and 55.

The finger member 52 has at the end thereof facing the charge 53 a flange 56 forming a piston, a return spring 57 being mounted between the flange 56 and a shoulder 58 provided at the end of the bore 51 opposed to the charge 53.

The finger member 52 associated with each charge 53 is adapted to shift the push-member 50 through the agency of the disc 49 which has axial orifices 59 for putting the chambers it defines in the bore 58 in communication with each other.

The disc 49 carries a positioning rod 31 which is part of a positioning device which is similar to that described with reference to FIGS. 1 to 4 and therefore will not be described again.

The device described with reference to FIGS. 1 to 4 operates in the following manner:

It will be assumed that the safety fixture for a ski to which the device is applied is first in the locked state shown in FIG. 1.

In this state, the clamp 2 of the fixture is maintained in position against the sole of the shoe C by the bolt member 4.

Moreover, the elements of the fixture and unlocking device occupy the relative positions shown in FIG. 1.

A cartridge 22 contained in the barrel 17 is located in front of the orifice 23 of communication between the cartridge and the chamber 25 of the jack 24, 25.

When the electronic circuit 43 detects critical conditions liable to put the skier in danger, it produces an output pulse which is applied to the charge 22 through the connector 42.

The charge 22 is thus ignited or fired and produces gases which enter the chamber 26 of the jack 24, 25 and shift the piston 25. The push-member 16 integral with the piston 25 rotates, through the branch 15, the member 9 in the trigonometric sense and the branch 11 of said member 9 cooperates with the cam surface 12 of the clamp 2 and rotates the latter in the clockwise direction about the pin 3. The rotation of the clamp 2 consequently releases the shoe C and, owing to the fact that the nose portion 5 of the clamp 2 has passed beyond the bolt member 4, the clamp is maintained by the bolt member in its raised position shown in FIG. 4.

Figure 4:
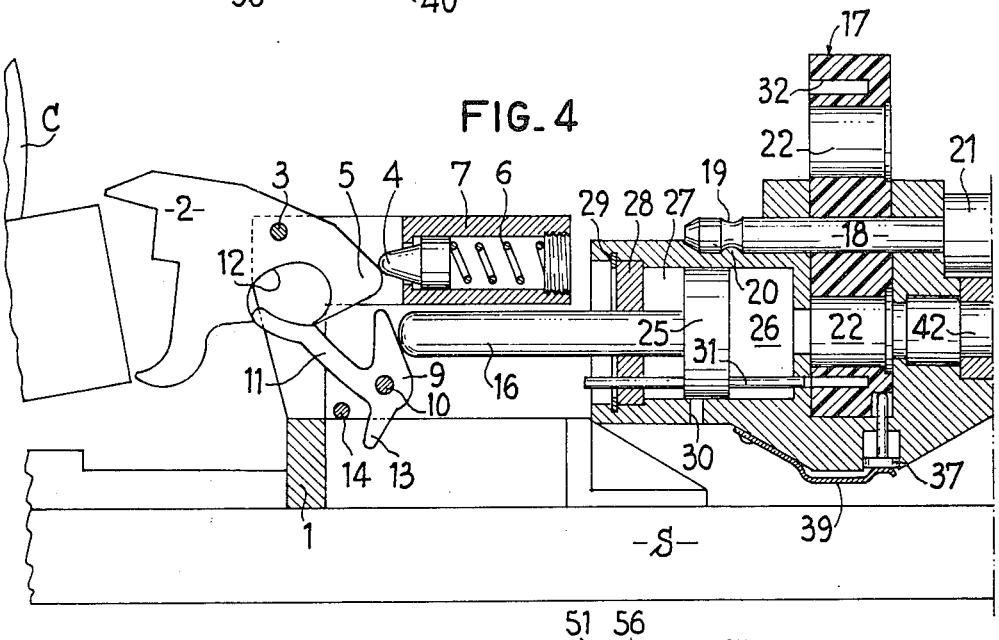
FIG. 4 is a view similar to FIG. 1 of the device in the unlocked state.

At the start of an unlocking operation, the pawl 37 bears against a portion 40 of decreasing section of a cam 35. Consequently, when the positioning rod 31 moves out of the recess 32 that it occupied, the pawl 37, under the action of the spring 39, acts on the released barrel 17 and rotates it through an angle of 30° corresponding to the angular extent of the cam portion 40. The assembly shown in FIG. 4 is then in waiting or ready position. In this position, no cartridge is in contact with the connector 42. Consequently, no accidental explosion can occur. The pawl 37 is in its lower position so that the spring 39 is unstressed. The push-member 16 is in its innermost position and the chamber 26 is put in communication with the atmosphere.

When re-arming the fixture, the clamp 2 is rotated in the trigonometric sense so that the cam surface 12 of the clamp, in acting on the branch 11 of the member 9, causes the latter to return to the position thereof shown in FIG. 1 and urges back the push-member 16 and consequently the piston 25 and the positioning rod 31 toward the barrel 17.

The rod 31 is then in alignment with a new recess 32 of the barrel 17 and enters the recess and is applied against the ramp-shaped inner end 33 (FIG. 3). The cooperation between the rod 31 and the inner ramp-shaped end 33 of the recess 32 produces simultaneously a new rotation through 30° of the barrel and a displacement of the pawl 37 along the portion 41 of increasing section of the cam 35.

At the end of the displacement of the rod 31 on the ramp 33 of the recess 32, a new charge 22 is located in alignment with the jack 24, 25 and the spring 39 of the pawl 37 is once again stressed so that the device is again ready to unlock the fixture.

In the embodiment described and illustrated, the cycle which has just been described can be effected six times, but it will be understood that a device could be provided having a number of charges different from six.

After the last explosion, the pawl 37 causes a rotation of the barrel 17 through merely 20°. At the end of this rotation, the pawl 37 comes into engagement with the stop 36 (FIG. 2). The jack 24, 25 is then blocked in the position thereof in which the push-member 16 is in its outer position and the locking of the fixture is thus rendered impossible.

In this case, the re-arming of the device is achieved by withdrawing the plug pin 18, removing the barrel 17 and introducing a new barrel. This arrangement permits avoiding the necessity of counting the explosions or checking the number of cartridges which remain to be used.

The operation of the device shown in FIG. 5 will now be described.

When a charge of powder 53 is ignited by the electronic circuit in the manner described with reference to FIGS. 1 to 4, it gives off gases which exert a pressure on the discs 54 and 55. The disc 55 does not become deformed whereas the disc 54, which is provided with an O-ring, is free to move in the bore 51 as soon as the force exerted thereon by the gases given off by the charge 53 exceeds a given threshold value. The disc 54 therefore moves toward the shoulder 53 constituting an abutment and exerts a thrust on the finger member 52 which acts on the push-member 50 through the disc 49 which causes the unlocking of the fixture in the manner described hereinbefore. When the charge has operated, the disc 54 is located at a minimal distance from the abutment 58 and the gases produced by the charge 53 are confined between the two discs 54 and 55. Upon the cooling of these gases, their pressure drops and the spring 57 urges the finger member 52 into the barrel. When the finger member 52 has returned to its initial position in the barrel, the latter can turn again.

It will be observed that the cooling of the gases occurs when the device is in the waiting position mentioned hereinbefore with reference to the embodiment shown in FIGS. 1–4.

Moreover, the device shown in FIG. 5 operates in the same way as that described hereinbefore.

The device shown in FIG. 5 has the following advantage over the previously-described device.

The device shown in FIG. 1 is not sealed in the region of the pyrotechnic jack owing to the necessity of evacuating the gases from the chamber 26 of the jack by way of the apertures 30 communicating with the atmosphere.

The fact that the chambers of the jack 24, 25 are in contact with the exterior is liable to cause a clogging of the device and therefore requires a periodic cleaning.

This drawback is avoided in the device shown in FIG. 5 since there is no longer any jack having an active chamber. Indeed, the rod 50 is merely guided in translation by the disc 40 and transmits the force exerted on this disc by the finger member 52 which is in front of the disc.

Each charge of the barrel 45, with which a jack 51, 52 is associated, therefore constitutes a perfectly-sealed independent system.

Figure 6:
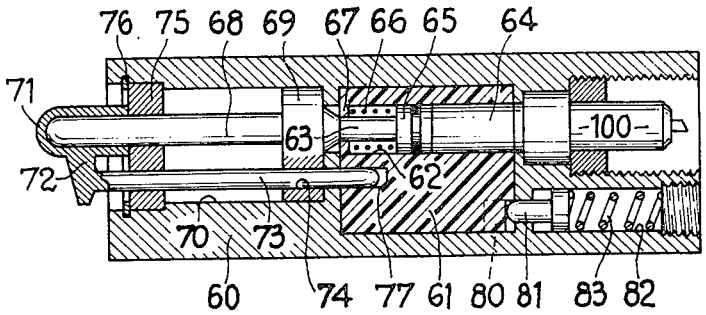
FIG. 6 is a partial sectional view of the locking device having a rectilinear loader according to the invention.

The unlocking device shown in FIG. 6 is, as the previously-described devices, adapted to be fixed to a ski and associated with a safety fixture or attachment comprising a clamp for holding the sole of a shoe and pivotally mounted and maintained in the closed position by a bolt member applied by a spring against a nose portion of the clamp.

It comprises a body 60 fixed to a ski (not shown) in which there is mounted to be movable in translation a loader 61 of rectangular-sided shape containing a series of bores 62 in each of which there is slidably mounted a finger member 63 which is shiftable by a pyrotechnic charge in the form of a cartridge 64.

The finger member 63 has at the end thereof adjacent the cartridge 64 a flange 65 constituting a piston and a return spring 66 is placed between the flange 65 and a shoulder 67 formed at the end of the bore 66 opposed to the cartridge 64.

The finger member 63 associated with the cartridge 64 is adapted to shift a push-member 68 which shifts the bolt member of the fixture (not shown). At the end thereof engaged in the body 60, the push-member 68 is carried by a disc 69 which is mounted to be movable in translation in a bore 70 of the body 60.

At the end of the push-member 68 opposed to the disc 69 there is fitted an end member 71 to which is fixed by a tab portion 72 a rod 73 for positioning the loader 61 in translation.

The rod 73 extends through an orifice 74 formed in the disc 69. The assembly consisting of the push-member 68 and the rod 73 is slidably mounted in a plug 75 mounted at the end of the bore 70 opposed to the loader 61 and held stationary by a circlip 76.

Figure 7:
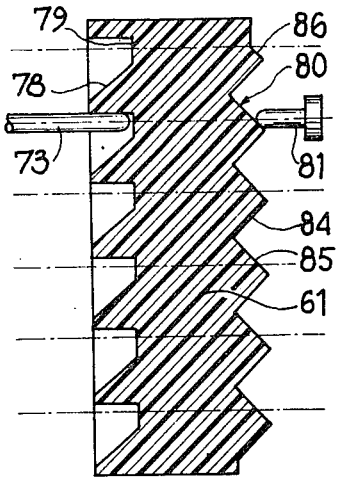
FIG. 7 is a sectional view of the loader of the device shown in FIG. 6.

As already described, the positioning rod 73 cooperates with recesses 77 formed at regular intervals in the face of the loader 61 facing the push-member 68. The number of recesses 77 is equal to the number of cartridges 64. As shown in FIG. 7, the inner end of each recess has a portion 78 in the form of a ramp extended by a portion 79 of maximum depth.

In the face thereof opposed to the recesses 77, the loader is provided with a series of cams 80 the number of which is equal to the number of cartridges 64 contained in the loader.

The cams 80 are interconnected, with the exception of the two end cams of the loader.

The cams 80 cooperate with a follower or pawl 81 which is movable, in a direction perpendicular to the direction of displacement of the loader 71, in a cavity 82 formed in the body 60 and applied or biased against the cams 80 by a spring 83.

Each cam 80 has a decreasing portion 84 and an increasing portion 85 of equal length. At one end, the loader 61 has a ramp 86 which is operative only when the loader 61 is empty.

When the pawl 81 bears against a decreasing portion 85, it moves the loader 61 in translation under the action of the spring 83, whereas when the pawl 81 bear against an increasing portion 84 it causes a compression of the spring 83 by the displacement in translation of the loader 61 under the action of the positioning rod 73 which cooperates with the ramp 78 of the recess 77 in which it is engaged.

Figure 8:
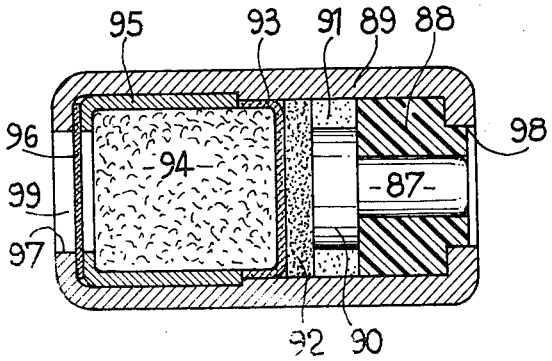
FIG. 8 is a sectional view, to an enlarged scale, of a cartridge employed in the device shown in FIG. 6.

The loader of the unlocking device shown in FIG. 6 is supplied with propelling cartridges such as the cartridge shown in FIG. 8.

This cartridge comprises a stud 87 of brass which is a force-fit in an insulating ring 88 which is a force-fit in a brass outer case 89.

The inner end of the stud 87 is constituted by a disc 90 which is separated from the case 89 by a conductive composition 91 which allows the passage of the electric current from the stud 87 to said case 89.

An igniting or primer composition 92 is also disposed in the case 89 against the disc 90. Placed against the composition 92 is a cup 93 of nitrocellulose which separates the primer composition 92 from a propelling powder charge 94 contained in an inner liner 95 provided with a thin closing disc 96 of, for example, tin or nitrofilm which closes an axial orifice 97 formed in the case 89.

When the inner liner 95 contains the propulsive powder 94, it is fitted in the case 89, the forming over of which case forms the orifice 97 and an orifice 98 facing the stud 87.

The assembly is then immersed in a sealing varnish 99.

The electro-pyrotechnic unlocking device shown in FIG. 6 comprises an electric connector 100 connected to an electronic control circuit (not shown) and adapted to transmit to the cartridge 64 an electric igniting or firing pulse produced by the electronic circuit.

The device described with reference to FIGS. 6 to 8 operates in the following manner:

It is assumed that the safety fixture or attachment (not shown) to which the device is applied is in the locked state.

The elements of the unlocking device according to the invention then occupy the relative positions shown in FIG. 6.

A cartridge 64 contained in the loader 61 is in front of the disc 69 carrying the push-member 68.

When the electric connector 100 transmits a firing signal to the cartridge 64, the current produced by this signal is transmitted by the stud 87 (FIG. 8) and by the conductive composition 91 and ignites the primer composition 92. The latter ignites the propulsive powder 94 by way of the cup 93 of nitrocellulose which is destroyed by the combustion of the primer composition 92.

The propelling charge 94 generates gases under pressure which shift the finger member 63 which acts on the push-member 68 through the disc 69. The push-member 68 unlocks the fixture in the manner described with reference to FIGS. 1 and 5.

At the start of the unlocking operation, the pawl 81 bears against a decreasing portion 85 of a cam 80. Consequently, when the positioning rod 73 moves out of the recess 77 that it occupies, the pawl 81, under the action of the spring 83, acts on the released loader 61 and shifts it in translation a distance corresponding to that necessary to enable that pawl 81 to reach the inner end of the corresponding cam 80.

The assembly is then in the waiting position.

In this position, no cartridge is in contact with the connector 100. Consequently, no accidental explosion can occur.

The pawl 81 is in such position that the spring 88 is unstressed.

Upon re-arming the fixture, the push-member 68 is returned to the position shown in FIG. 6.

In the course of this displacement, the positioning rod 73 which is integral with the push-member which is then in alignment with a new recess 77 of the loader 61, enters the latter and is applied against the ramp-shaped inner end 78.

The cooperation of the rod 73 and the inner end 78 of the recess 77 produces simultaneously a new displacement in translation of the loader 61 and the displacement of the pawl 81 along the increasing portion 84 of the cam 80.

At the end of the displacement of the rod 73 on the ramp 78 of the recess 77, a new cartridge 64 is placed in alignment with the connector 100 and the spring 83 of the pawl 81 is once again compressed, so that the device is once more ready to unlock the fixture.

After utilization of the last cartridge 64, the pawl 81, in moving along the ramp 86, shifts the loader 61 such distance that the positioning rod 73 can no longer enter a recess 77.

Under these conditions, the push-member 73 cannot be returned to its initial position so that it is impossible to lock the fixture.

Figure 9:
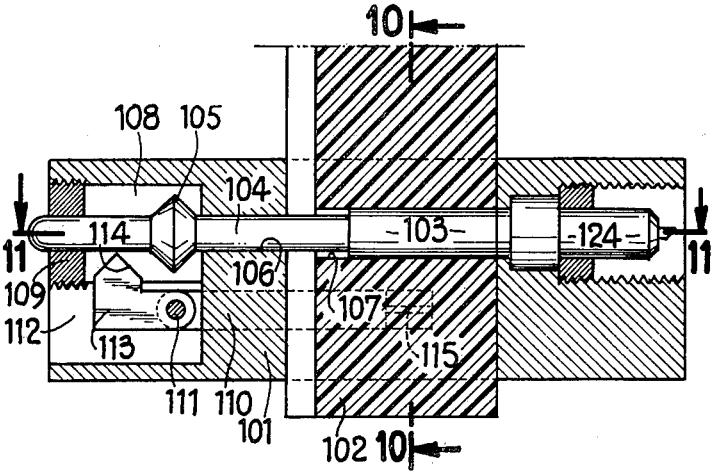
FIG. 9 is a top plan view of another embodiment of the locking device according to the invention.

The unlocking device shown in FIG. 9 comprises a body 101 in which there is mounted to be movable in translation a loader 102 containing a series of pyrotechnic jacks 103 disposed equal distances apart from each other.

In the body 101 there is also mounted to be movable in translation a push-member 104 for unlocking the fixture with which the device is associated. This push-member has a biconical portion 105. It is slidably mounted in a bore 106 in the body 101 and penetrates, in the position of rest, the cavity 107 of the pyrotechnic jack 103 formed in the loader 102.

The bore 106 is extended in the direction opposed to the loader 102 by a cavity 108 in which the biconical portion 105 is freely movable in translation. This cavity is closed by a plug 109 through which the end of the push-member 104 extends.

A lever 110 controlling the translation is pivotally mounted on a pin 111 mounted in a slot 112 communicating with the cavity 108. It is returned to its position of equilibrium by a spring (not shown). This lever 110 has a first cranked portion 113 which terminates in a ramp 114 cooperating with the biconical portion 105 of the push-member 104.

The lever 110 also has a second cranked portion 114 which terminates in the form of a flexible blade 115 adapted to be engaged in notches 116 formed in a face of the loader 102. The blade 115 bears against the side or flank 117 of the notch 116.

When the lever 110 pivots about the pin 111, the blade 115 pushes against the side 117 and shifts the loader 102.

Figure 10:
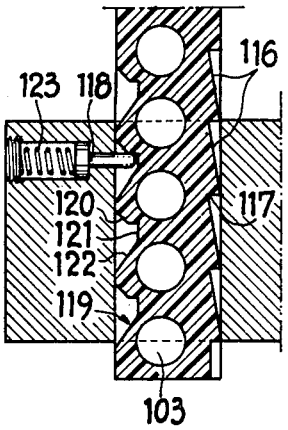
FIG. 10 is a sectional view taken on line 10—10 of FIG. 9.

With reference to FIG. 10, it can be seen that the device also comprises a follower or pawl 118 which cooperates with cam surfaces 119 which are formed on the face of the loader opposed to the notches 116 and each comprise a decreasing portion 120, a portion of constant depth 121 and an increasing portion 122.

The number of notches 116 and cams 119 is equal to the number of pyrotechnic jacks that the loader 102 has.

The piston 118 is applied by a spring 123 against the face of the loader 102 in which the cams 119 are formed.

The device further comprises, disposed in the body 101 and in alignment with the push-member 104, a connector 124 for supplying current to the pyrotechnic jacks 103 of the loader 102.

Figure 12:
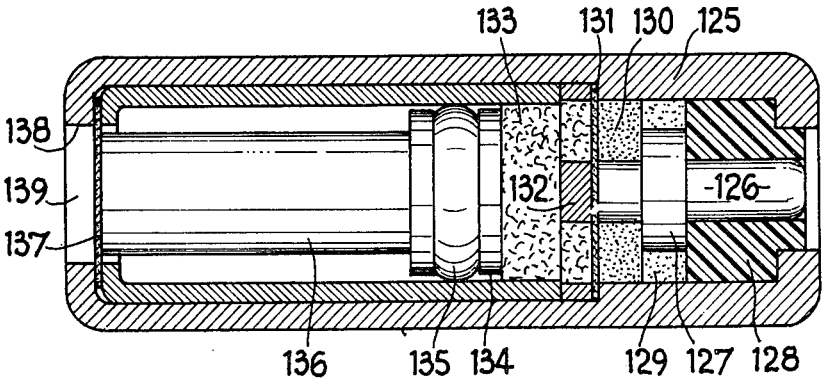
FIGS. 12 and 13 are sectional views, to an enlarged scale, of a cartridge employed in the device shown in FIG. 9, and FIGS. 14 to 16 are sectional views, to an enlarged scale, of cartridges the case of which is constituted by the loader itself.

The pyrotechnic jacks 103 disposed in the loader are of the type shown in FIG. 12.

The jack shown in FIG. 12 comprises an outer brass case 125 at the end of which there is mounted a brass stud 126 provided at one end with a disc 127 and a force-fit in a ring 128 of insulating material which is a force-fit in the case.

The disc 127 of the stud is surrounded by a conductive composition 129 in contact with the outer case 125 and with a primer composition 130.

The latter is compressed by an insulating disc 131 against which a grid 132 bears.

The propelling powder 133 is confined between the insulating disc 131 and a piston 134 which is provided with a sealing element 135. The piston 134 is extended by a rod 136 whose end opposed to the piston bears against a closing disc 137 which closes the end orifice 138 of the case 125.

A varnish 139 seals the system.

It will be observed that the pyrotechnic jack combines the functions of the cartridge and the jack which were disassociated in the foregoing embodiment. However, the spring returning the rod of the jack to its initial position is eliminated so that a jack which has been employed maintains its rod in the outer position.

Figure 11:
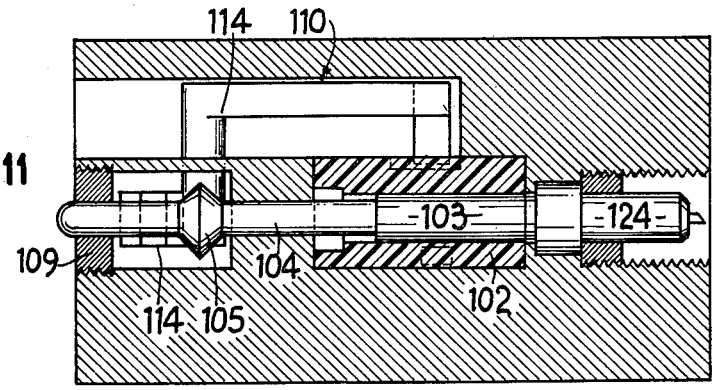
FIG. 11 is a sectional view taken on line 11—11 of FIG. 9.

The device shown in FIGS. 9 to 11 operates in the following manner:

Upon the ignition or firing of the pyrotechnic jack 103 which is in alignment with the supply connector 124, the push-member 104 which initially occupied the position shown in FIG. 9 is pushed by the rod 136 of the jack 103 and unlocks the fixture (not shown) with which the device is associated.

Upon the displacement of the push-member 104, the biconical portion 105 of the latter encounters the ramp 114 of the cranked lever 110 and pivots it about the pin 111.

The flexible blade 115 secured to the other end of the lever 110 bears against the side 117 of the notch 116 in which it is engaged and this causes a first displacement of the loader 102 in the course of the unlocking operation.

The displacement of the loader urges back the pawl 118 which bears against the increasing portion 122 of the corresponding cam 119 and this compresses the spring 123. This displacement occurs until the pawl 118 arrives at the beginning of the decreasing portion 120 of the cam 119.

The rod 136 of the pyrotechnic jack 103 is then no longer in contact with the push-member 104 and the translation of the loader continues under the action of the pawl 118 which is biased by the spring 123 and slides on the decreasing portion 120 of the cam 119.

The following cartridge is positioned when the pawl 118 is located at the inner end of the recess defined by the part 121 of constant depth of the cam 119.

In the embodiment described with reference to FIGS. 9 to 11, it is the energy given out by the cartridge which compresses the spring 123 and not the energy furnished by the user upon the locking of the fixture as in the embodiment shown in FIG. 6.

The pyrotechnic jack with the integrated electric primer may also be employed in the device shown in FIG. 6 provided a return spring for the jack rod is added.

Figure 13:
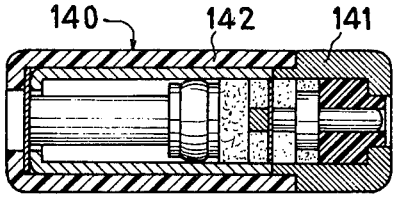

FIG. 13 shows a cartridge similar to that shown in FIG. 12 except that the case 140 of the latter has a rear portion 141 of an electrically conductive material and a front portion 140 of insulating material, for example plastics material.

Figure 14:
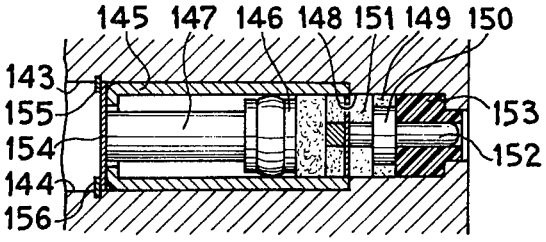

FIG. 14 shows another embodiment of a loader of a material which is electrically conductive and whose walls define the bores 143 for receiving pyrotechnic jacks and constitute the cases of said jacks and their actuating charges.

For this purpose, each bore 143 is stepped and has a portion 144 of larger diameter in which there is mounted a sleeve 145 which receives, as in the embodiment shown in FIG. 12, a piston 146 extended by a rod 147. The bore 143 has a portion 148 of smaller diameter for receiving a conductive composition 149 which surrounds a brass disc 150 and a primer composition 151. The disc 150 is extended by a stud 152 which is a force-fit in an insulating ring 153 which is a force-fit in the portion 158 of smaller diameter of the bore 153.

The rod 157 of the piston bears against a closing member 154 which is held in position by an elastically yieldable washer 155 engaged in a groove 156 formed in the bore 143.

Moreover, the contents of the bore 143 is identical to that of the jack shown in FIG. 12.

Figure 15:
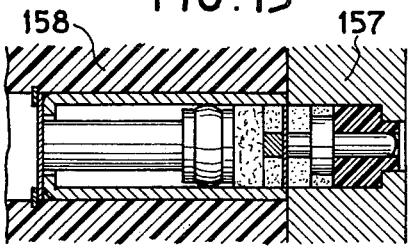

FIG. 15 shows another embodiment of the loader of FIG. 14 in which the part 157 of the loader, extending between the contact stud and the primer charge, is made from an electrically conductive material, the remaining part 158 being made from an insulating material and being assembled with the part 157 by any suitable means.

Figure 16:
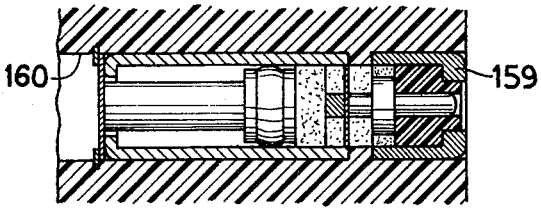

FIG. 16 shows another embodiment of the loader according to the invention in which the whole of the loader is of an insulating material, the conductive parts required for the operation of the charges being constituted by tubular elements 159 which are a force-fit in corresponding bores 160 of the loader.

Moreover, the loaders shown in FIGS. 15 and 16 are identical to the loader shown in FIG. 14.

The assembly just described is adapted to unlock a ski fixture when the limit conditions of forces that the leg of the skier is capable of withstanding are reached.

It may also serve to unlock a safety belt and may be generally employed each time there is a problem of a violent, rapid and repeated mechanical action.

The features of the violent and rapid action are given by the pyrotechnic jack, whereas the repeated feature is achieved owing to the presence of a loader carrying a plurality of charges and automatically positioned.

Having now described my invention what I claim as new and desire to secure by Letters Patent is:

1. An automatically re-armed and reloaded electro-pyrotechnic unlocking device in particular for a safety ski binding, comprising a body, at least one gas operated mechanical assembly for unlocking said binding, a loader movably mounted relative to said body, a plurality of pyrotechnic charges for actuating said assembly in succession and carried by the loader, means for igniting the charges, and means for automatically positioning the charges of the loader with respect to said assembly and with respect to said means for igniting the charges, wherein said mechanical assembly comprises a piston and cylinder unit associated with one of the charges carried by the loader and provided with a push-member which when actuated by the gas releases the binding.

2. A device as claimed in claim 1, wherein said mechanical assembly comprises a cylinder, a piston slidably mounted in the cylinder and carrying a push-member, the cylinder having an inner end portion, an orifice provided in said inner end portion for connection of the cylinder with one of said charges carried by said loader.

3. A device as claimed in claim 1, comprising a shaft parallel to the direction of displacement of the push-member and constituted by a plug pin which is detachably mounted in the body of the device, and means for holding the plug pin stationary in translation.

4. A device as claimed in claim 1, wherein said at least one gas operated mechanical assembly comprises as many piston and cylinder units as there are charges carried by said loader and a push-member, said units being also carried by the loader, in registration with the corresponding charges, each unit being located in a position intermediate between said push-member and the corresponding charge.

5. A device as claimed in claim 1, wherein each of said units comprises a finger member for actuating said push-member, said finger member being slidably mounted in a corresponding bore and provided at an end of the finger member in the vicinity of the charge with a flange, the bore having a shoulder at an end of the bore opposed to the charge and acting as an abutment, and a return spring surrounding the finger member and disposed between said flange and the abutment.

6. A device as claimed in claim 1, wherein said means for positioning the charges with respect to said mechanical assembly and to said charge igniting means comprise recesses having an inclined face and an innermost end face and formed in a face of said loader which faces said assembly, said recesses being in a number which is equal to the number of charges and so disposed that said innermost end face of each recess is capable of facing the centre of a charge, a rod connected to said assembly and co-operating with said recesses, a number of cams equal to the number of charges and formed in a lateral face of the loader, at least one pawl for shifting the loader by cooperation with and application against said cams, and elastically yieldable means for biasing said pawl against each one of said cams in succession.

7. A device as claimed in claim 6, wherein the displacement of said loader under the action of said pawl occurs in the course of the unlocking operation, upon the retraction of the positioning rod out of the recess that it previously occupied, whereas the displacement of the loader under the action of the cooperation of the rod with the ramp of the innermost end face of the recess which follows occurs upon the operation of the re-arming of the device.

8. A device as claimed in claim 1, wherein said loader is of rectilinear shape and movable in translation with respect to said push-member and to said charge igniting means by said positioning means of the loader.

9. A device as claimed in claim 8, wherein bores are formed in said loader and said charges are constituted by cartridges disposed in the bores, each cartridge comprising an outer case at one of which outer case there is mounted a stud of an electrically conductive material, and an electrically ignitable primer composition within the outer case and in contact with the stud, said outer case being constructed from an electrically conductive material at least to a region of the primer composition, a propelling or deflagrating powder charge mounted adjacent an opposite end of the case to said stud the case having an orifice for the passage of the gases actuating the push-rod, a thin disc closing the orifice, the propelling powder charge being retained within the case by said disc which closes said orifice, the primer composition being capable of igniting the propelling powder charge.

10. A device as claimed in claim 9, wherein the common case of the powder charges is constituted by the loader made from an electrically conductive material at least to the region of the primer composition.

11. A device as claimed in claim 9, wherein said charges comprise an outer case at one end of which outer case there is mounted a stud of an electrically conductive material, a primer composition ignited electrically and in contact with said stud, said case being made from an electrically conductive material at least to the region of the primer composition, a propelling or deflagrating powder charge, said primer composition being capable of igniting the propelling powder charge, a piston slidably mounted in said case and having a rod adapted to actuate the unlocking system for the binding, said propelling powder charge being capable of actuating the piston.

12. A device as claimed in claim 11, wherein the loader comprises a part made from an electrically conductive material and a part made from an insulating material.

13. A device as claimed in claim 11, wherein the loader is made wholly from an insulating material, tubular elements of an electrically conductive material being disposed in corresponding bores of the loader.

14. A device as claimed in claim 1, wherein said piston defines with the cylinder two chambers, the cylinder being provided with an aperture for putting said chambers in succession in communication with the atmosphere upon a displacement of said piston under the effect of gases produced by said charge connected to the cylinder by way of said orifice.

15. A device as claimed in claim 14, wherein each of said units comprises a first disc which is movable in said bore when the force exerted by the pressure of the gases produced by the charge exceeds a predetermined threshold value and a second fixed disc constituting an inner end of the cylinder of said unit, the charge being confined in a sealed manner between said discs.

16. A device as claimed in claim 15, wherein each cam has a portion of decreasing section and a portion of increasing section the extent of the portion of decreasing section of each cam extending the extent of the corresponding recess and defining with the corresponding recess the travel of the loader between two successive charges.

17. A device as claimed in claim 15, comprising, incorporated in each one of said charges, a piston and cylinder unit for actuating said push-member, the charge and the unit being disposed in a common case.

18. A device as claimed in claim 15, wherein the lateral face of said loader further comprises an abutment which is encountered at the end of the utilization of the loader.

19. A device as claimed in claim 18, wherein said barrel includes recesses cooperating with a rod integral with said push-member said recesses being curved and disposed around said charges in such a manner that the deepest end of each recess is located on a radius of the barrel passing through the centre of a charge.

20. A device as claimed in claim 19, wherein said means for positioning the loader with respect to said push-member and to said igniting means comprise cam surfaces formed in lateral faces of the loader perpendicular to a face of the loader in which there are formed bores receiving said charges, the number of said cam surfaces formed in each of said lateral faces of the loader being equal to the number of charges of said loader.

21. A device as claimed in claim 19 wherein said rectilinear movable in translation loader contains a row of charges fixedly mounted therein and adapted to be automatically aligned in succession with said push-member for unlocking or releasing the binding.

22. A device as claimed in claim 21, comprising a cranked lever pivotally mounted in the body of the device, and a biconical portion of said push-member, the cam surfaces formed in one of the lateral faces of said loader being constituted by notches cooperative with an end of said lever, said lever having adjacent an end thereof opposed to said end cooperative with said notches a cranked portion perpendicular to the rest of said lever and cooperative with the biconical portion of said push-member.

23. A device as claimed in claim 21, wherein a positioning rod is connected to said push-member and the cam surfaces formed in one of the lateral faces of said loader cooperate with the positioning rod and are constituted by rectilinear recesses formed at regular intervals in said loader, each recess having an inner end a portion of which inner end is in the form of a ramp and another portion of which inner end is of maximum depth, whereas the cam surfaces formed in another lateral face of the loader are each constituted by a decreasing portion and an increasing portion of equal length, a spring-loaded pawl being cooperative with said cam surfaces formed in said other lateral face of the loader for shifting the loader.

24. A device as claimed in claim 23, wherein said end of the cranked lever cooperative with the notches is constituted by an elastically yieldable blade;

25. A device as claimed in claim 23, wherein said notches have a side adapted to receive the force exerted by said end of the cranked lever cooperative with the notches for shifting the loader in translation.

26. A device as claimed in claim 23, wherein the cam surfaces formed in said other lateral face of said loader each comprise a decreasing portion, a portion of constant depth, and an increasing portion and a spring-loaded pawl is cooperative with said cam surfaces for shifting the loader in translation, the relative positions of said cams and corresponding notches being such that said pawl is depressed in the course of the displacement of said loader under the effect of the pivoting of said lever upon the displacement of the unlocking push-member.

27. A safety binding in combination with an automatically re-armed and reloaded electro-pyrotechnic unlocking device, comprising a body, at least one gas operated mechanical assembly for unlocking said binding, a loader movably mounted relative to said body, a plurality of pyrotechnic charges for actuating said assembly in succession and carried by the loader, means for igniting the charges, and means for automatically positioning the charges of the loader with respect to said assembly and with respect to said means for igniting the charges, wherein said mechanical assembly comprises a piston and cylinder unit associated with one of the charges corried by the loader and provided with a push-member which when actuated by the gas releases the binding.

* * * * *